US007140069B1

(12) United States Patent
Dangerfield et al.

(10) Patent No.: US 7,140,069 B1
(45) Date of Patent: Nov. 28, 2006

(54) GREASE EXTRACTOR

(76) Inventors: John N. Dangerfield, 7735 Glen Oaks Dr., Baton Rouge, LA (US) 70805; Michael Boehm, 716 Woodland Hills Rd., Batavia, IL (US) 60510

( * ) Notice: Subject to any disclaimer, the term of this patent is extended or adjusted under 35 U.S.C. 154(b) by 252 days.

(21) Appl. No.: 10/199,693

(22) Filed: Jul. 19, 2002

(51) Int. Cl.
*A47L 9/22* (2006.01)

(52) U.S. Cl. ..... 15/412; 15/344; 15/352

(58) Field of Classification Search ..... 15/344, 15/352, 347, 412, 415.1, 405, 330, 414; 411/402, 411/403, 549, 553
See application file for complete search history.

(56) References Cited

U.S. PATENT DOCUMENTS

| | | | | | |
|---|---|---|---|---|---|
| 2,552,805 | A | * | 5/1951 | Murphy | 411/549 |
| 2,711,554 | A | * | 6/1955 | Doyle, Sr. | 15/419 |
| 2,887,035 | A | | 5/1959 | De Seversky | |
| 3,334,370 | A | * | 8/1967 | Boyd | 15/344 |
| 3,914,820 | A | | 10/1975 | Hankel | 15/344 |
| 4,129,066 | A | | 12/1978 | Corley | 99/345 |
| 4,175,352 | A | * | 11/1979 | Catlett | 15/344 |
| 4,570,286 | A | * | 2/1986 | Ross | 15/344 |
| 4,573,237 | A | * | 3/1986 | Kochte et al. | 15/344 |
| 4,622,135 | A | | 11/1986 | Williams | 210/167 |
| 4,979,255 | A | | 12/1990 | Buchnag | 15/4 |
| 4,987,975 | A | | 1/1991 | Liu | 184/105.1 |
| 5,054,159 | A | * | 10/1991 | Richardson | 15/400 |
| 5,377,383 | A | * | 1/1995 | Christensen | 15/344 |
| 5,394,789 | A | | 3/1995 | Evans et al. | 99/345 |
| 5,408,919 | A | | 4/1995 | Hutzler et al. | 99/345 |
| 5,638,872 | A | | 6/1997 | Porter | 141/26 |
| 5,771,531 | A | * | 6/1998 | Swartz | 15/344 |
| 5,787,799 | A | | 8/1998 | Mohrhauser et al. | 99/345 |
| 5,904,160 | A | * | 5/1999 | Wright | 15/344 |
| 5,907,887 | A | | 6/1999 | Mansur | 15/320 |
| 6,216,314 | B1 | | 4/2001 | Dangerfield | 15/344 |

* cited by examiner

*Primary Examiner*—Theresa T. Snider
(74) *Attorney, Agent, or Firm*—Kenneth L Tolar

(57) ABSTRACT

A grease extractor for removing grease from culinary utensils includes a substantially hollow housing formed of a pair of separable sections. Within the housing is an impeller chamber with a vacuum impeller removably received therein. Attached to the housing and positioned adjacent the impeller is an electric motor. A pivotal suction nozzle is removably attached to the housing and is in communication with the impeller chamber. The nozzle is elongated and tapered towards an inlet. Removably attached to the nozzle inlet is one of a plurality of interchangeable vacuum tips. A grease reservoir is removably secured to the housing and is in communication with the impeller chamber for collecting grease extracted from a culinary utensil or other external device.

12 Claims, 8 Drawing Sheets

GREASE EXTRACTOR

BACKGROUND OF THE INVENTION

The present invention relates to a grease extractor, and specifically, a portable hand-held device for extracting grease from culinary utensils.

DESCRIPTION OF THE PRIOR ART

Certain foods that are high in fat such as beef and bacon typically produce a significant volume of grease when heated. The generated grease accumulates within a pot or pan, causing the food to be greasier and, therefore, less tasteful. Furthermore, food cooked in the generated grease is typically higher in calories.

In addition, many foods are typically fried in grease that must be either stored or discarded after cooking. Disposing of the accumulated grease after cooking is burdensome and difficult, and in some cases results in burns or other serious injuries. Pouring grease down a drain often results in a clogged drainpipe. Transferring the accumulated grease to a separate storage or disposal container typically results in spillage. Furthermore, if the grease is allowed to cool, it typically hardens making disposal even more difficult, if not impossible. The present invention overcomes the above-described disadvantages by providing a compact, portable device that allows a user to quickly and conveniently remove accumulated grease from a culinary utensil so that the grease can be properly discarded or transferred to a storage container for reuse.

Other devices have been heretofore designed to assist a user in removing accumulated grease. For example, U.S. Pat. No. 6,216,314 issued to Dangerfield discloses a grease vacuum having a tapered nozzle with a vacuum assembly received therein. The nozzle delivers grease to an interior grease storage reservoir received within the housing. The reservoir is drained via an external nozzle. A second embodiment includes a motor-driven belt protruding from the tip for absorbing grease.

U.S. Pat. No. 3,914,820 issued to Hankel discloses a vacuum for cleaning grills including an oscillating plate for dislodging debris and a vacuum assembly for removing and collecting the dislodged debris.

U.S. Pat. No. 4,979,255 issued to Buchnag discloses an apparatus for scrubbing a grill including a rotating head having a scrubbing pad and scraper attached thereto. The device also includes a detergent dispensing system and a vacuum system.

U.S. Pat. No. 4,987,975 issued to Liu discloses a portable automobile grease vacuum including a rotating shaft, a suction joint, a suction tube and a lubricant discharger.

U.S. Pat. No. 5,907,887 issued to Mansur discloses a floor washing apparatus for removing oil, grease and similar contaminants including a wheel-mounted housing with a removable suction head.

U.S. Pat. No. 4,622,135 issued to Williams discloses a grease filtering apparatus including an oil filtering system, a pump and a liquid circulating system.

As indicated above, numerous devices exist for removing grease. Particularly, U.S. Pat. No. 6,216,314 issued to Dangerfield discloses a portable device for removing grease from culinary utensils. The present invention provides numerous improvements to the device disclosed in '314 issued to Dangerfield. The patented device includes an internal reservoir that must be drained via a drain nozzle, which is cumbersome and awkward. In addition, no means for removing, replacing and/or cleaning the internal components is disclosed. Furthermore, the housing design prevents the device from being easily maneuvered within confined or restricted spaces. Finally, the versatility of the device is somewhat limited in that it can only be practically used as a liquid vacuum.

The present invention overcomes the disadvantages associated with the prior art by providing a portable, compact grease extractor that quickly and conveniently removes grease from a culinary device. The device includes a tapered, pivotal nozzle for easily accessing accumulated grease regardless of its position relative to the housing. Furthermore, the housing and the internal components are easily separable allowing the device to be easily disassembled for cleaning and/or replacement. The device also includes a removable grease reservoir whereby the grease collected can be more conveniently discarded. Furthermore, the vacuum impellers and vacuum tips are interchangeable allowing the device to function as a dry vacuum, if desired.

SUMMARY OF THE INVENTION

The present invention relates to a grease extractor including a substantially hollow housing with a vacuum assembly received therein. The vacuum assembly includes a battery-powered motor that drives a removable impeller. Pivotally attached to the housing is a detachable, tapered nozzle with any one of a plurality of interchangeable vacuum tips secured thereto. The nozzle is in communication with a detachable, grease storage receptacle. The housing is composed of a pair separable sections joined with locking pins allowing the internal components to be replaced, removed and/or cleaned, if desired. The extractor can be easily converted to a dry vacuum, if necessary by replacing the impeller and vacuum tip.

It is therefore an object of the present invention to provide a grease extractor that is portable and easy to operate.

It is another object of the present invention to provide a grease extractor having a tapered, pivotal nozzle for conveniently extracting grease from culinary utensils.

It is yet another object of the present invention to provide a grease extractor having a separable housing with removable internal components which allow the device to be conveniently disassembled for cleaning.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
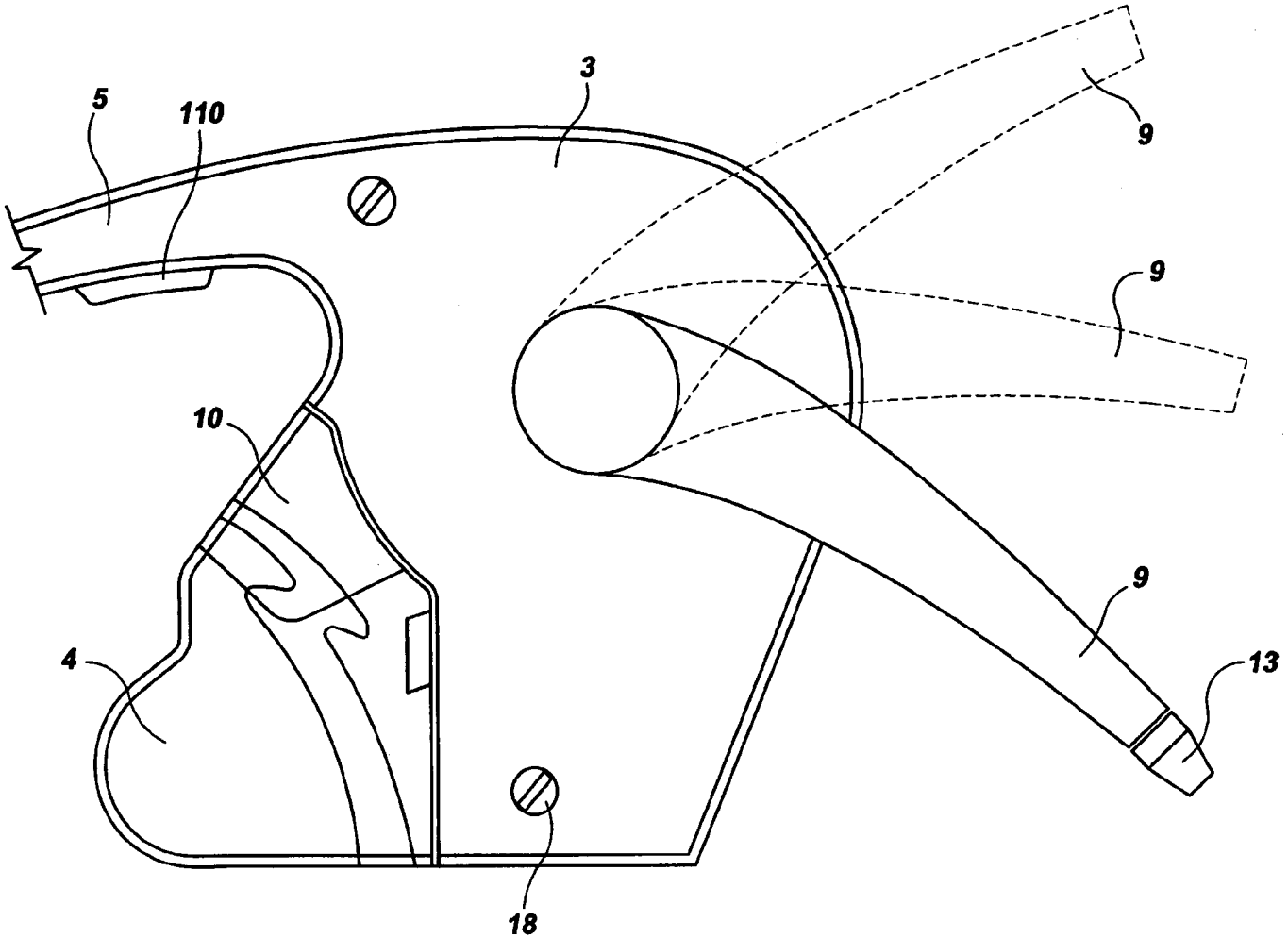
FIG. 1 is a side, plan view of the grease extractor according to the present invention.

Referring now to FIG. 1, the present invention relates to a compact, portable grease extractor designed to primarily remove grease from culinary utensils. The device includes a substantially hollow housing 3 having a handle 5 extending outwardly therefrom. The housing includes a substantially circular impeller chamber 7 having a shaft 40 mounted therein.

Pivotally secured to the housing and superimposed on the impeller chamber is a vacuum nozzle 9 having an inlet 9A, an outlet 9B and an elbow therebetween. The nozzle is elongated and tapered toward the outlet. Preferably, the nozzle is constructed with a flexible, but resilient, material such as rubber.

Figure 3:
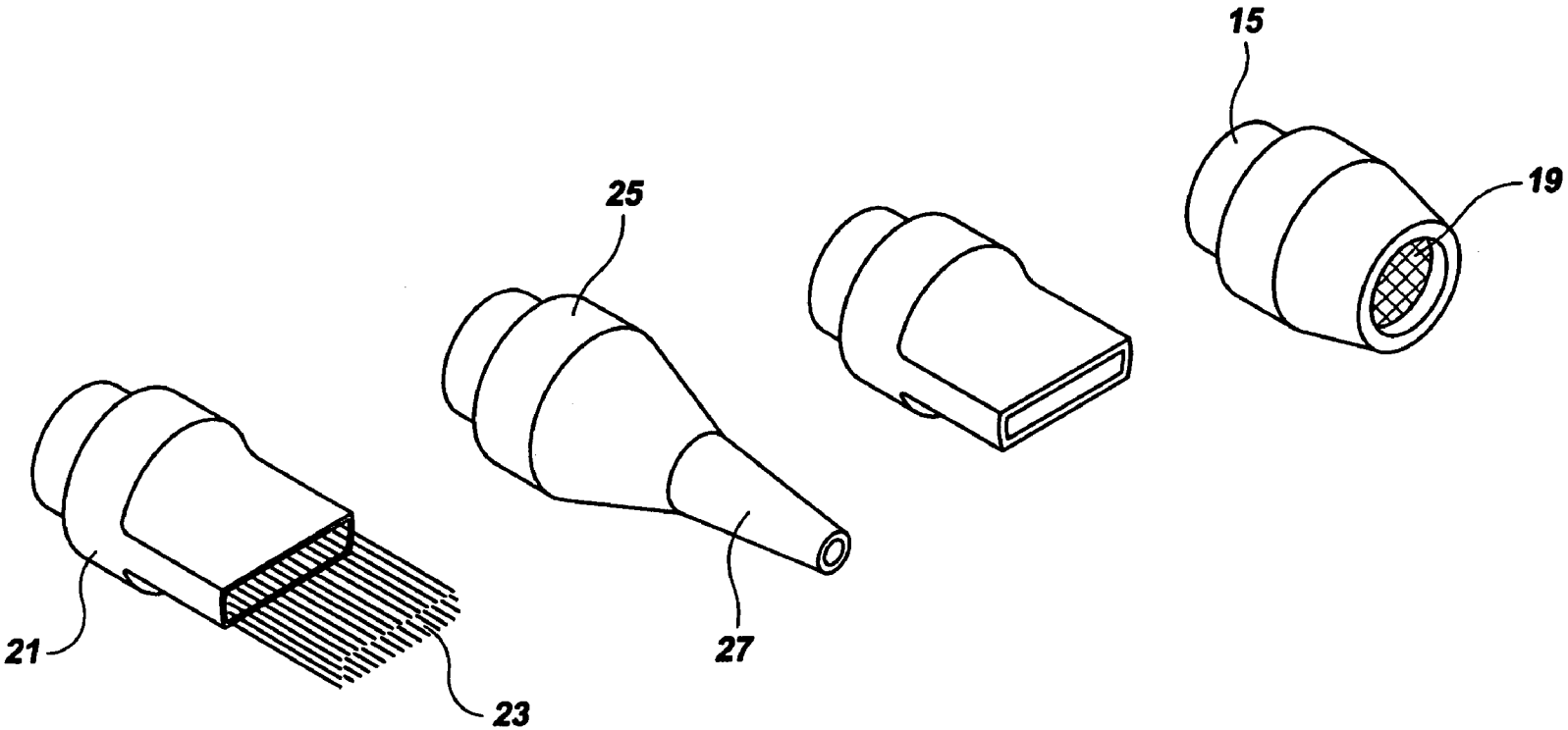
FIG. 3 depicts a plurality of interchangeable vacuum tips.

Removably secured to the nozzle inlet is one of a plurality of interchangeable suction tips 13 each likewise having an inlet and outlet. The outlet includes a collar 15 having a diameter slightly less than the diameter of the nozzle inlet; the collar is inserted to the nozzle inlet to removably secure the tip thereto. The inlet of at least one of the tips includes a screen 19 for preventing debris and particulates entrained within the grease from entering the nozzle. As depicted in FIG. 3, each tip is interchangeable and is designed for a particular application. For example, a first tip 21 may include a brush 23 for cleaning a computer screen or other delicate surfaces. A second tip 25 could include a narrow throat 27 for cleaning computer keyboards, counter tops or other confined spaces.

Figure 9:
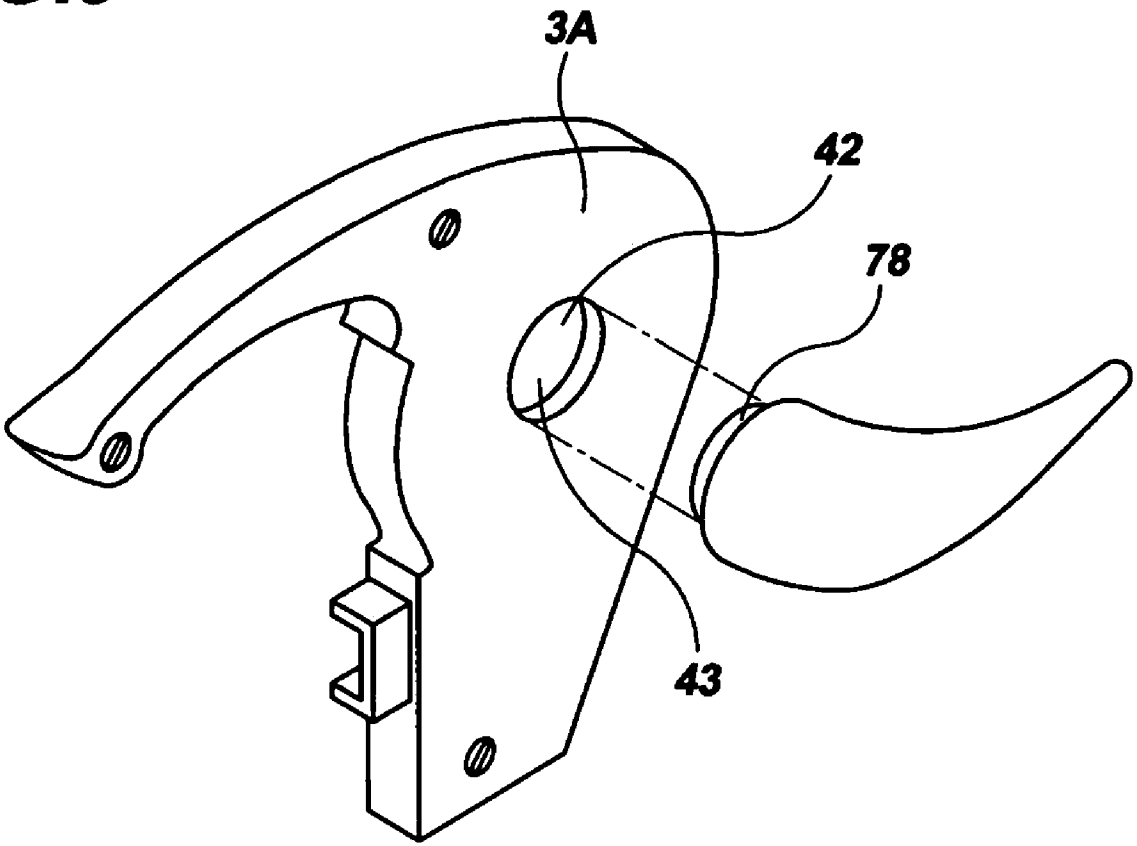
FIG. 9 is a perspective view of a housing section with the detachable nozzle offset therefrom.
Figure 11:
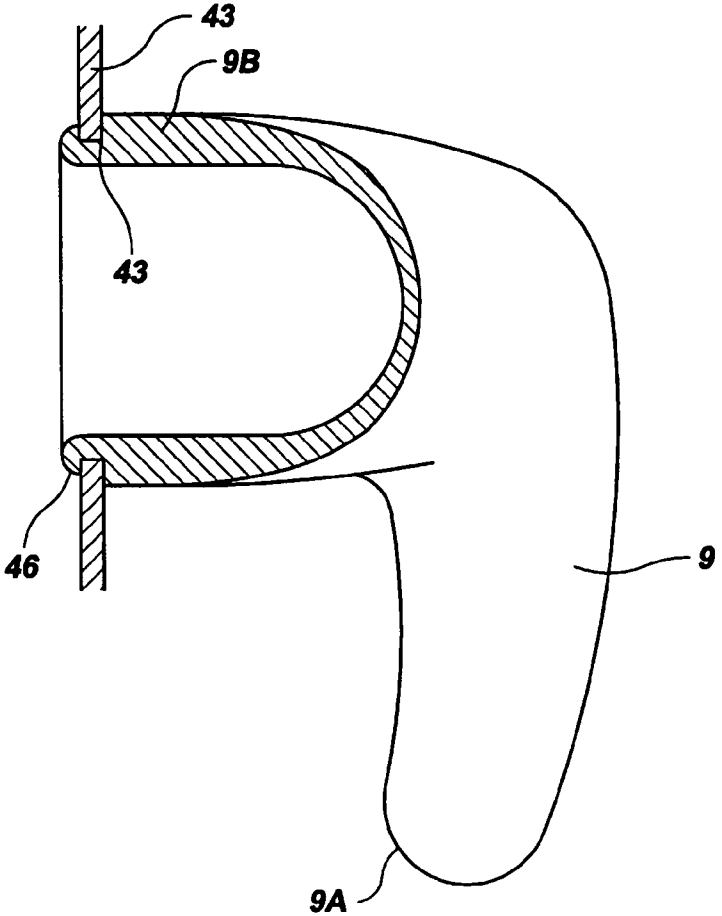
FIG. 11 is a cross-sectional view of the housing section and nozzle with the nozzle secured thereto.
Figure 10:
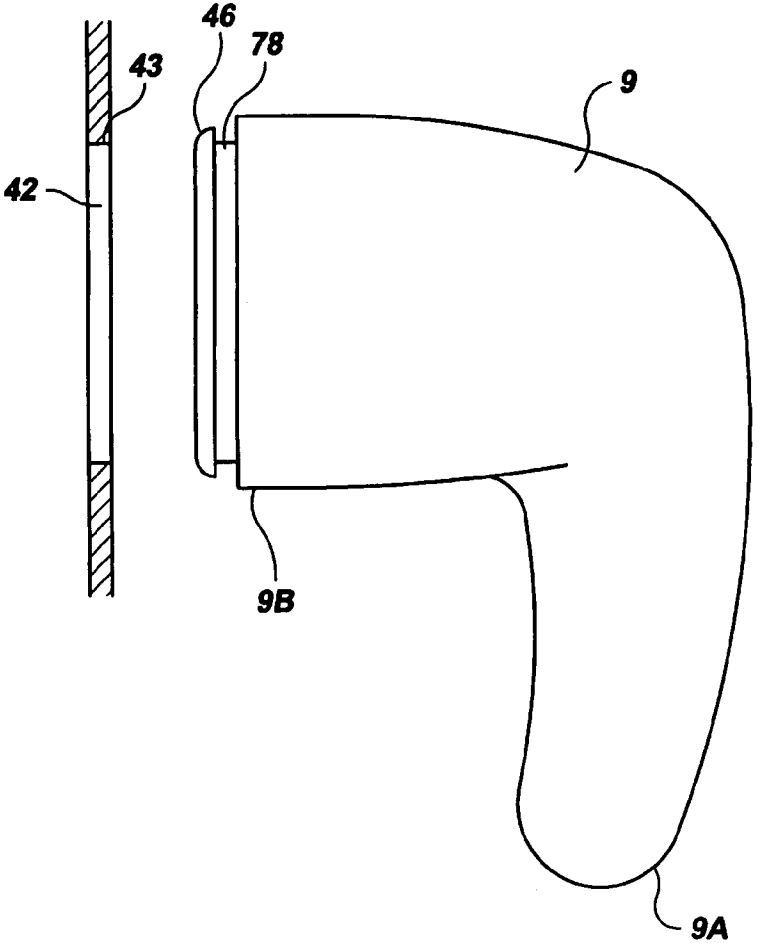
FIG. 10 is a cross-sectional view of the nozzle and housing section described in FIG. 11.

Now referring to FIGS. 9–11, the nozzle is detachable from the housing section to assist a user in cleaning the device. Furthermore, the nozzle is pivotally attached to the housing allowing a user to more easily maneuver the vacuum tip within obstructed or confined spaces. A first housing section 3A includes an aperture 42 forming an annular rim 43. Extending from the nozzle outlet is a circular retaining lip 46. Between the lip and the nozzle is a circular indention 78 that receives the annular rim on the housing section to secure the nozzle thereto. Furthermore, when the nozzle is fastened to the housing, the rim functions as a bearing surface on which the nozzle can freely rotate within a range of 360 degrees whereby the vacuum tip can be more easily maneuvered.

The lip and indention are constructed with a resilient but flexible material similar to that of the nozzle thereby allowing the nozzle lip to be compressed and forced through the aperture 42 when removing and attaching the nozzle. To fasten the nozzle, a user forces the flexible lip through the aperture until the lip is completely disposed on the inner surface of the housing section. The rim will then seat within the indention thereby securing the nozzle to the housing. The nozzle can be easily removed by compressing the nozzle outlet and retracting the lip through the aperture.

Figure 2:
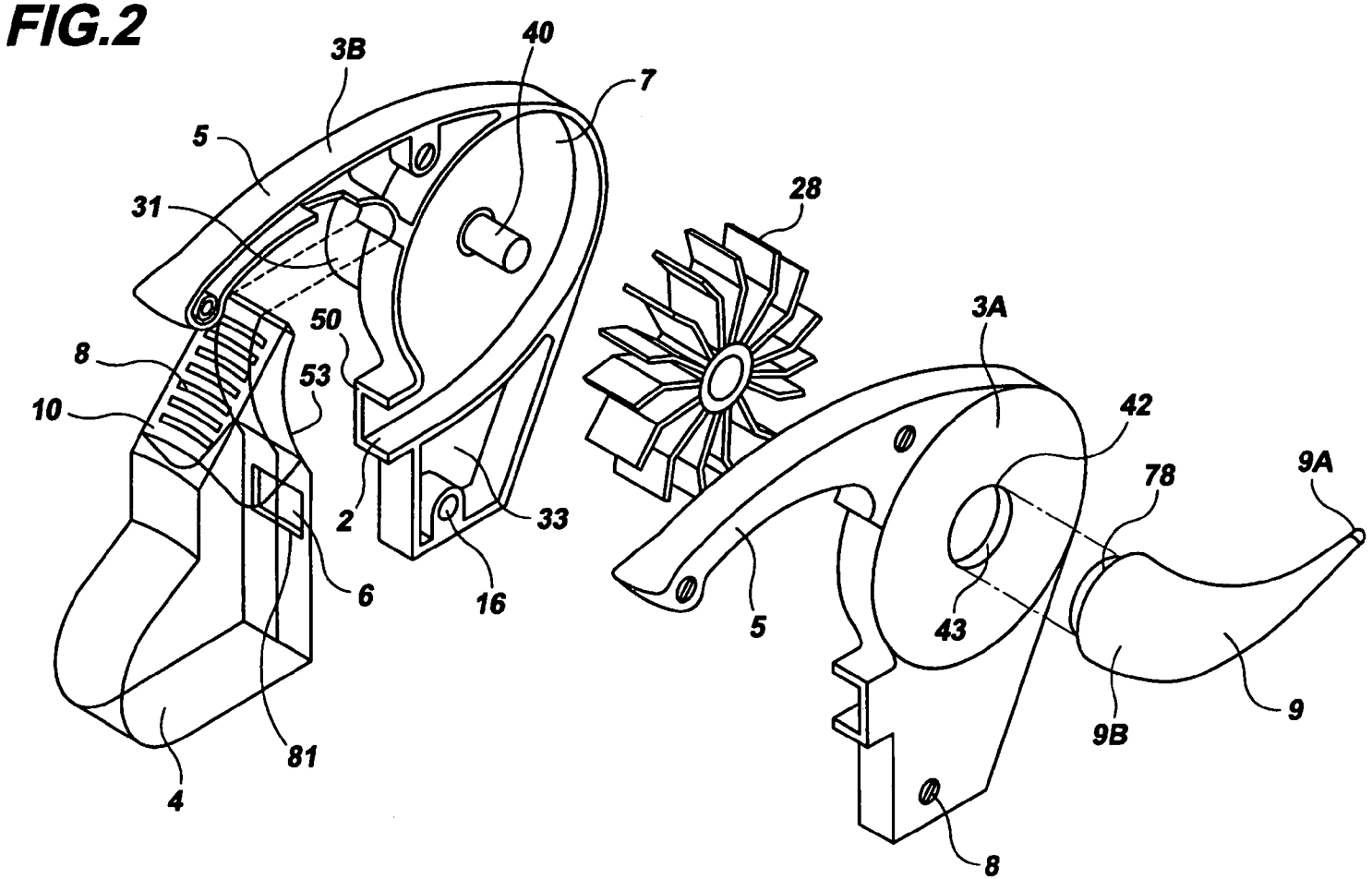
FIG. 2 is an exploded view of the grease extractor.

Now referring to FIGS. 1–2, superimposed on the impeller chamber, on a side opposite the vacuum nozzle, is a DC motor 31 for operating the shaft. The housing also includes a battery pack chamber 33 for receiving a rechargeable battery pack that provides power to the electric motor. A variable speed, power control switch 110 on the handle delivers power from the battery to the motor.

Within the interior of the housing is a channel 2 that is in communication with the impeller chamber and terminates at an exit 50. A removable grease reservoir 4 includes an opening 6 that registers with the channel exit 50 when the reservoir is properly coupled with the housing. Accordingly, when the motor is activated, grease is extracted through the nozzle into the impeller chamber and then to the reservoir.

Figure 4:
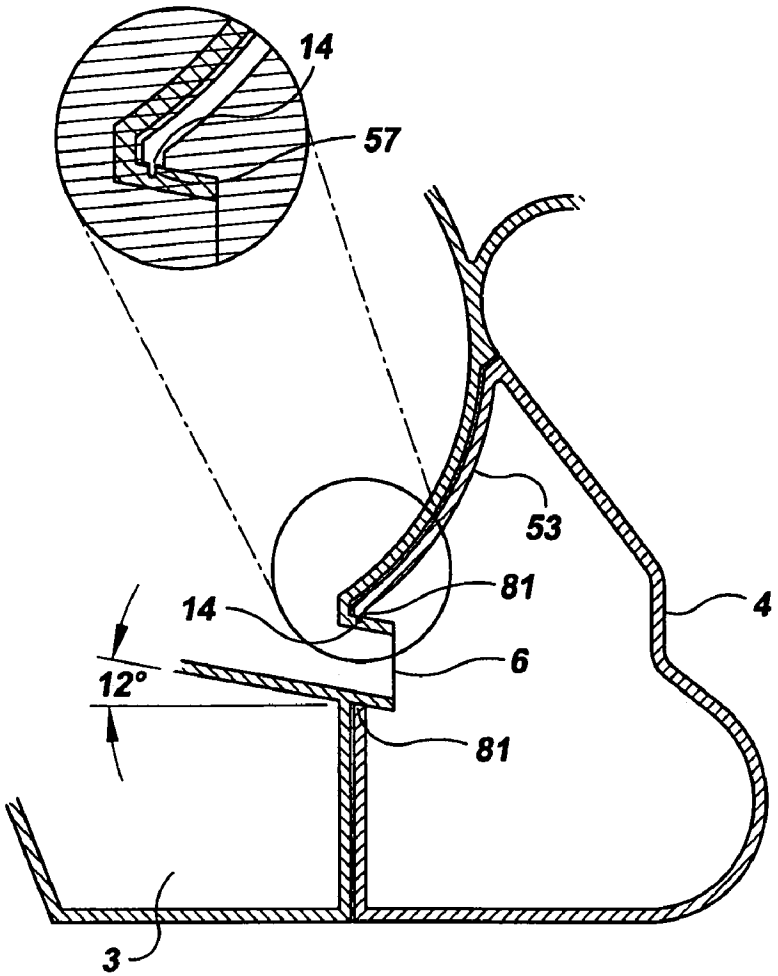
FIG. 4 is a side cross-sectional view of the housing, depicting the detent mechanism by which the reservoir is removably attached to the housing.

Now referring to FIG. 4, the reservoir is removably secured to the housing using a detent mechanism. The reservoir includes a concave front wall 53 with an opening 6 disposed thereon. The opening is defined by four edges 81 one of which includes a protrusion 14 depending therefrom. The upper wall of the channel includes a detent 57 that removably receives the protrusion on the reservoir securing the reservoir to the housing. Accordingly, the reservoir can be easily detached for emptying or cleaning.

A top portion 10 of the reservoir includes exhaust vents 8 for relieving pressure within the reservoir. The top portion 10 is separable from the remainder of the reservoir to assist a user in cleaning the reservoir interior. Preferably, the grease reservoir is transparent allowing a user to readily determine when the reservoir is full.

Figure 6:
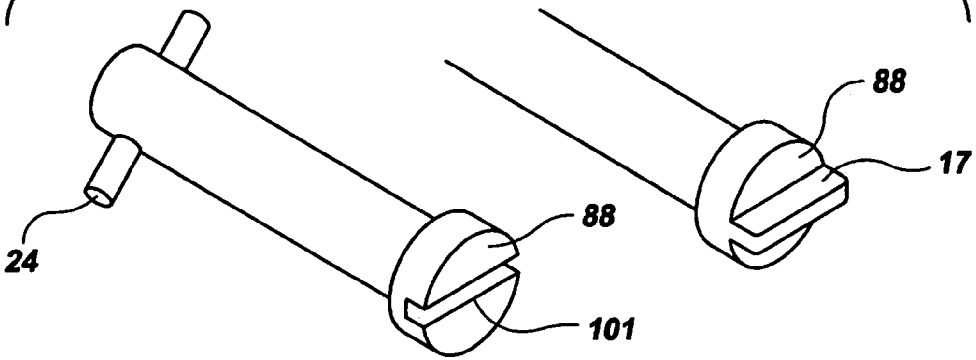
FIG. 6 depicts a pair of slightly differently designed locking pins that join the two separable housing sections.
Figure 8:
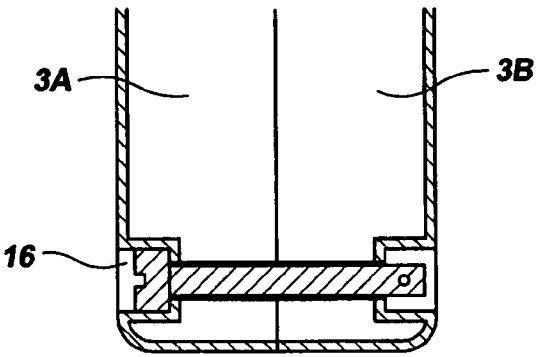
FIG. 8 is a perspective view of the locking pin mechanism taken along line A—A in FIG. 9.
Figure 7:
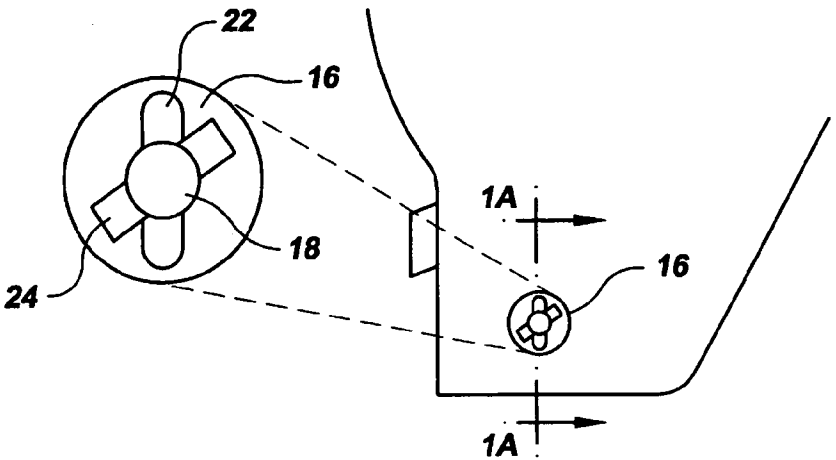
FIG. 7 is a detailed view of the locking pin rotated to a locked position.

Now referring to FIGS. 6–8, the housing is preferably formed of two separable sections is 3A, 3B allowing the internal components to be removed and cleaned, if desired. Each section includes recessed eyelets 16 peripherally disposed about its interior for receiving attachment pins 18. Each eyelet on one of the sections includes a vertical keyway 22 for receiving a cross-member 24 on a first end of each pin. An opposing end of the pin includes a head 88 having a notch 101 formed thereon. Alternatively, each head may include a raised tab 17, which may be grasped by a user to rotate the pin.

To assemble the housing, the sections are positioned whereby the eyelet on one section is properly aligned with a corresponding eyelet on the other section. Each pin is inserted into a pair of aligned eyelets and is rotated by hand, or using a coin or screwdriver until the cross member is in a vertical position. The cross member is then inserted into the keyway and the pin is rotated approximately ninety degrees thereby securing each pin within the eyelet. The housing can be disassembled by twisting the pins ninety degrees, or until the teeth realign with the keyway, thereby allowing the pins to be removed from the eyelets.

Figure 5:
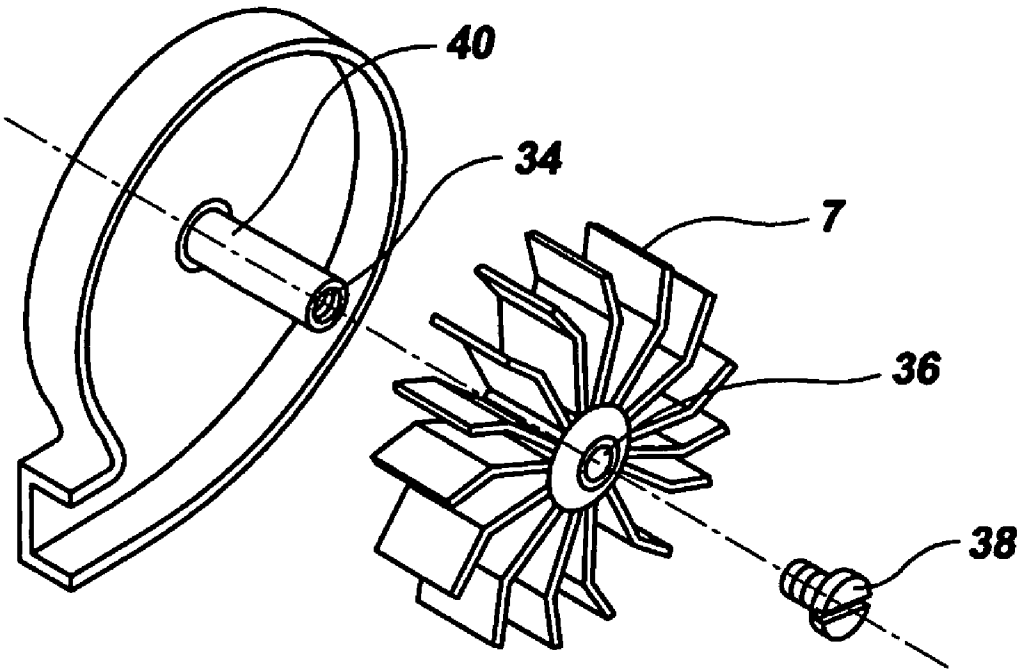
FIG. 5 is a perspective view of the shaft and detachable impeller.

Now referring to FIGS. 2 and 5, the vacuum impeller 28 is removably attached to the shaft 40. The impeller could be open-walled or partially walled depending on the application, i.e., dry or liquid use. Accordingly, a user can conveniently convert the device between a wet and dry vacuum by interchanging the impellers and the above-described vacuum tips. The shaft is substantially hollow and includes an internally threaded distal end 34. Each impeller includes a central bore 36 for receiving both the shaft and an externally threaded attachment screw 38. Accordingly, the impeller is mounted onto the shaft and the screw is fastened within the internally threaded end of the shaft. The impeller can be easily removed for cleaning or replaced to convert the extractor to or from a wet/dry vacuum.

As described above, the present invention provides a convenient, easy-to-use portable grease extractor for removing grease from culinary utensils and other external devices. Although there has been shown and described the preferred embodiment of the present invention, the device is not limited to the exact details of construction and arrangement of parts enumerated above. It will be readily apparent to those skilled in the art that modifications may be made to the present invention that do not exceed the scope of the appended claims. Therefore, the scope of the invention is only to be limited by the following claims.

What is claimed is:

1. A grease extractor comprising:

a substantially hollow housing having an exterior, at least one interior chamber, said housing formed of first and second separable sections;

a grease reservoir removably attached to said housing;

a vacuum means for creating a suction within said housing wherein said vacuum means includes an impeller received within said interior chamber and an electrical motor secured to the exterior of said housing, said motor having a shaft extending through said housing and into said interior chamber, said shaft connected to said impeller for rotating said impeller;

an elongated vacuum nozzle pivotally attached to said housing, said nozzle tapering toward a distal end.

2. The extractor according to claim 1 wherein said impeller is removably mounted within said chamber.

3. The extractor according to claim 2 further comprising:

wherein said shaft includes an internally threaded end;

a bore on said impeller for receiving said shaft;

an externally threaded screw threadedly engaging said internally threaded end of said shaft to removably mount said impeller on said shaft.

4. The extractor according to claim 1 further comprising a plurality of interchangeable tips, each tip removably attachable to the distal end of said nozzle.

5. The extractor according to claim 4 wherein each of said interchangeable tips includes an inlet and an outlet with a screen disposed over said inlet for removing particulates.

6. The extractor according to claim 1 wherein said grease reservoir is transparent.

7. The extractor according to claim 1 further comprising:

said first and second separable sections including a plurality of peripherally disposed eyelets, each eyelet on said first section aligned with an eyelet on said second section, each eyelet on said second section including a keyway;

a plurality of pins, each pin received within aligned eyelets on said first and second sections, each pin having a cross member on an end thereof that is inserted into said keyway whereby said pin is rotated to secure said first and second separable sections together.

8. The extractor according to claim 1 further comprising:

an aperture on said first housing section, said aperture forming a rim;

a lip on an end of said nozzle with an indention proximal thereto, said indention receiving said rim to removably secure said nozzle to said housing.

9. The extractor according to claim 1 further comprising:

said reservoir having a rear wall with an opening thereon and a protrusion positioned within said opening;

a channel within said housing, said channel terminating at an exit, said channel partially defined by a wall having a detent thereon for receiving said protrusion to secure said reservoir to said housing, said opening aligned with said exit when said reservoir is secured to said housing.

10. The extractor according to claim 1 wherein said grease reservoir includes exhaust vents thereon.

11. The extractor according to claim 1 wherein said impeller is open-walled.

12. The extractor according to claim 1 wherein said impeller is partially walled.

* * * * *